US011149517B2

(12) United States Patent
Lowry

(10) Patent No.: US 11,149,517 B2
(45) Date of Patent: Oct. 19, 2021

(54) EXPANDING THERMITE REACTIONS FOR DOWNHOLE APPLICATIONS

(71) Applicant: Olympic Research, Inc., Port Townsend, WA (US)

(72) Inventor: William Edward Lowry, Port Townsend, WA (US)

(73) Assignee: ISOL8 (HOLDINGS) LIMITED, Aberdeen (GB)

( * ) Notice: Subject to any disclaimer, the term of this patent is extended or adjusted under 35 U.S.C. 154(b) by 238 days.

(21) Appl. No.: 16/237,861

(22) Filed: Jan. 2, 2019

(65) Prior Publication Data

US 2020/0208494 A1 Jul. 2, 2020

(51) Int. Cl.

| | |
|---|---|
| ***E21B 33/134*** | (2006.01) |
| ***E21B 21/00*** | (2006.01) |
| ***E21B 43/02*** | (2006.01) |

(52) U.S. Cl.

CPC ..... *E21B 33/134* (2013.01); *E21B 21/003* (2013.01); *E21B 43/02* (2013.01)

(58) Field of Classification Search

CPC .. E21B 33/134; E21B 33/138; E21B 33/1208; E21B 21/003; E21B 43/02; E21B 43/082

See application file for complete search history.

(56) References Cited

U.S. PATENT DOCUMENTS

| | | | | |
|---|---|---|---|---|
| 5,159,983 | A | 11/1992 | Barron et al. | |
| 5,613,557 | A | 3/1997 | Blount et al. | |
| 6,627,013 | B2 * | 9/2003 | Carter, Jr. | C06B 33/00 149/37 |
| 6,925,937 | B2 | 8/2005 | Robertson | |
| 9,228,412 | B2 | 1/2016 | Lowry et al. | |
| 9,394,757 | B2 | 7/2016 | Lowry et al. | |
| 9,494,011 | B1 | 11/2016 | Lowry et al. | |
| 9,683,420 | B2 | 6/2017 | Skjold | |
| 2005/0199307 | A1 * | 9/2005 | Eden | E21B 33/1204 138/89 |

(Continued)

FOREIGN PATENT DOCUMENTS

WO 2013/135583 A1 9/2013

OTHER PUBLICATIONS

Wang, L.L. et al., Thermite Reactions: Their Utilization in the Synthesis and Processing of Materials, J. Materials Science, vol. 28, 1993, pp. 3693-3708.

(Continued)

*Primary Examiner* — Taras P Bemko
*Assistant Examiner* — Yanick A Akaragwe
(74) *Attorney, Agent, or Firm* — McDonnell Boehnen Hulbert & Berghoff LLP

(57) ABSTRACT

Methods and apparatus for forming platforms and flow control features in underground wells is described, using modified thermite reactions to form a ceramic plug in place. The reactive package is engineered to expand laterally, filling the well, and may be used to form a ceramic bridge plug, porous ceramic screen sections, or mitigate lost circulation of drilling fluids. These objectives are achieved through the design of the reactive package and through use of carefully chosen reaction additives that control the molten product rheology, solidification temperature, and pore generations and sustainment.

27 Claims, 9 Drawing Sheets

(56) References Cited

U.S. PATENT DOCUMENTS

| | | | | |
|---|---|---|---|---|
| 2006/0144591 | A1 | 7/2006 | Gonzalez et al. | |
| 2011/0146519 | A1 | 6/2011 | Han et al. | |
| 2012/0255742 | A1 | 10/2012 | Cortez | |
| 2015/0034317 | A1 | 2/2015 | Skjold | |
| 2018/0085850 | A1* | 3/2018 | Huang | E21B 33/1204 |

OTHER PUBLICATIONS

Fisher, S.H. et al., A Survey of Combustible Metals, Thermites and Intermetallics for Pyrotechnic Applications, presented at the 32nd AIAA/ASME/SE/ASEE Joint Propulsion Conference, Lake Buena Vista, FL, Jul. 1-3, 1996, 15 page.

Orru, R. et al., "Self-Propagating Thermite Reactions: Effect of Alumina and Silica in the Starting Mixture on the Structure of the Final Products", Metallurgical Science and Technology vol. 15(1), 1997, pp. 31-38.

Lowry, Bill et al., "Application of Controlled-Porosity Ceramic Material in Geothermal Drilling", Proceedings, 43rd Workshop on Geothermal Reservoir Engineering, Stanford University, Feb. 12-14, 2018, pp. 1-5.

Schipper, C. Ian et. al., "Vapour Dynamics During Magma-Water Interaction Experiments: Hydromagmatic Origins of Submarine Volcaniclastic Particles (Iimu o Pele)", Geophys. J. Int., vol. 192, 2013, 1109-1115.

Wohletz, Ken et. al., "Chapter 11—Magma-Water Interactions", Modeling Volcanic Processes: The Physics and Mathematics of Volcanism, eds. Sarah A. Fagents, Tracy K. P. Gregg, and Rosaly M. C. Lopes, Cambridge University Press 2012, pp. 230-257.

Moloodi, A. et al., "An Assessment of the Process of Self-Propagating High-Temperature Synthesis for the Fabrication of Porous Copper Composite", Journal of Alloys and Compounds, vol. 487, Nov. 2009, pp. 413-419.

Davidson Ron et al., "SPACE-DRUMS® A Commercial Facility for the ISS", International Astronautical Federation, 59th International Astronautical Congress 2008, IAC-08-A.6.B8, 8 pages.

Cole, Patrick et al., Geothermal Drilling: A Baseline Study of Nonproductive time Related to Lost Circulation, Proceedings, 42nd Workshop on Geothermal Reservoir Engineering, Stanford University, Feb. 13-15, 2017, pp. 1-13.

* cited by examiner

EXPANDING THERMITE REACTIONS FOR DOWNHOLE APPLICATIONS

STATEMENT OF GOVERNMENT SUPPORT

This invention was made with Government support under contract no. DE-SC0017209 awarded by the US Department of Energy, Office of Science. The Government has certain rights in this invention.

FIELD

This disclosure relates to a novel method and apparatus for forming platforms (plugs) and flow control features within underground wells, such as those used in the oil and gas industries, storage of underground waste, carbon sequestration, geothermal energy production and the like, using modified thermite reactions to form a ceramic plug in situ. The apparatus, in the form of a reactive package, is engineered to expand laterally, filling the well, and may be used to form a ceramic bridge plug, porous ceramic screen sections, or mitigate lost circulation of drilling fluids. The apparatus may be emplaced by any of a number of traditional well tool systems, including wirelines, slicklines, tubing or drill pipe.

DESCRIPTION OF RELATED ART

As used in this document, the term "thermite reaction" is intended to refer to a broad class of chemical reactions which can be defined as an exothermic reaction which involves a metal reacting with a metallic or a non-metallic oxide to form a more stable oxide and the corresponding metal or non-metal of the reactant oxide. This is a form of oxidation-reduction reaction which can be written in a general form as:

$$M+AO \rightarrow MO+A+\Delta H$$

where M is a metal or an alloy (typically, but not necessarily Aluminum) and A is either a metal or a non-metal, MO and AO are their corresponding oxides, and AH is the heat generated by the reaction. Commonly, AO is one of the species of Iron Oxide, such as $Fe_2O_3$ or $Fe_3O_4$. A typical thermite reaction is of the form $2Al+Fe_2O_3 \rightarrow 2\ Fe+Al_2O_3$. The reaction produces a great deal of heat per unit of mass, and can attain a reaction temperature of approximately 2,900° C.

Thermite reactions have many uses, including welding, pyrotechnics, synthesis and processing of materials, and military applications. Background information on thermite reactions is described in the review article of Wang et al., *Thermite reactions: their utilization for synthesis and processing of materials*, J. Materials Science 28 (1993) pp. 3693-3708; and in Fisher et al., *A survey of combustible metals, thermites and intermetallics for pyrotechnic applications*, presented at the 32$^{nd}$ AIAA/ASME/SE/ASEE Joint Propulsion Conference, Lake Buena Vista, Fla., Jul. 1-3 1996. Additional background information is found in Orru et al., *Self-propagating thermite reactions: effect of alumina and silica in the starting mixture on the structure of the final products*, Metallurgical Science and Technology 15 (1) (1997) pp. 31-38. The entire content of the Wang et al., Fisher et al. and Orru et al. articles is incorporated by reference herein.

Thermite reactions have also been proposed for well sealing application, see published PCT application WO 2013/133583 and U.S. patent application publication 2006/0144591. See also U.S. Pat. No. 6,923,263. Thermites have been applied in the drilling industry for blowout prevention (U.S. Pat. No. 5,159,983), explosive sealing of casing perforations (U.S. Pat. No. 5,613,557), gas generation for downhole tool actuation (U.S. Pat. No. 6,925,937), well perforation and hydrofracturing (U.S. patent application publication 2011/0146519) and downhole bonding of metal members (U.S. patent application publication 2012/0255742). Many other patents exist for welding and demolition with thermite in above ground applications, but these are not considered relevant to borehole seal applications.

The present Applicant is the assignee of several patents directed to forming a seal or plug within a well, see U.S. Pat. Nos. 9,494,011; 9,394,757 and 9,228,412. Other prior art of interest includes U.S. patent application publication 2015/0034317.

SUMMARY

As will be explained in the following detailed description, a novel approach to forming platforms and flow control features in underground wells is described, using modified thermite reactions to form a ceramic mass in place. The reactive package is engineered to expand laterally, filling the well, and may be used to form a ceramic bridge plug, porous ceramic screen sections, or mitigate lost circulation of drilling fluids. These objectives are achieved through use of a reaction package design, and carefully chosen reaction additives that control the molten product rheology, solidification temperature, and pore generations and sustainment.

In one specific embodiment, an apparatus in the form of a reaction package for forming a platform within a well is described. The apparatus includes: a) an elongate cylindrical housing having an upper end and a lower end; b) a thermite reaction mixture placed within the housing between the upper and lower ends; c) an upper closure closing off the upper end of the housing and a lower closure closing off the lower end of the housing; and d) an ignition module for triggering a thermite reaction of the mixture. The elongate cylindrical housing is configured with a structure for substantially preventing longitudinal expansion of products of the thermite reaction and promoting lateral expansion of the products of the thermite reaction. In one possible configuration, the structure is in the form of a heat resistant, flexible expanding fiber wrap surrounding the cylindrical housing. Such fiber wrap may also serve other functions, such as to promote adhesion of the products of the thermite reaction against the formation surrounding the well. The flexible expanding fiber wrap can take the form of a glass or ceramic fiber, or some other flexible material with sufficiently high strength and melt temperature to contain the reaction products until they have expanded to fill the well at the place where the apparatus is deployed.

In another configuration, the structure substantially preventing longitudinal expansion of products of the thermite reaction and promoting lateral expansion of the products takes the form of rigid bodies (for example, the elongate, high temperature resistant metal stringers in the following detailed description) which connect the upper and lower closures of the cylindrical housing, or adjacent structures such as wireline crossover at the top and an ignition module at the bottom. In one preferred embodiment there are a set of three or more rigid, high temperature resistant stringers equidistantly spaced around the cylindrical housing connecting the upper and lower closures or adjacent structures. When the thermite reaction mixture is ignited the rigid bodies essentially constrain the reaction products to expand only laterally outwardly and the connection between the upper and lower closures prevents longitudinal expansion of the reaction products. This embodiment may also include a heat resistant, flexible fiber wrap surrounding the cylindrical housing, either on top of or underneath the rigid bodies.

Embodiments of this disclosure may further include gas generating materials within the cylindrical housing, such that the products of the thermite reaction when they cool have a desired porosity provided by the gas. A variety of gas generating materials are contemplated: a) reactants placed within the thermite reaction mixture which produce gas; b) pressurized gas added to the thermite reaction mixture; c) pressurized air present within the cylindrical housing between the upper and lower closures, and/or d) a pressure balancing system placed within or adjacent to the cylindrical housing which is configured to add or inject gas into the thermite reaction. The pressure balancing system may take the form of a gas bottle or regulator located above the thermite reactive package, and thus may not necessarily reside within the package.

Some embodiments of this disclosure feature a dilution of the thermite reaction mixture with an additive promoting the retaining of gas within the products of the thermite reaction when it solidifies. In one configuration, the additive takes the form of a material having a substantially higher melting temperature than the reaction temperature of the thermite mixture, such as silicon carbide. In one possible embodiment, the thermite reaction mixture takes the form of an aluminothermite (iron oxide and aluminum) in which the silicon carbide is present in a sufficient amount and of a particle size that it prevents iron products from agglomerating and forming large masses of iron in the products of the thermite reaction. In other configurations, the additive is selected from the group consisting of aluminum oxide, silicon dioxide, and minerals with a lower melt temperature than the reaction temperature of the thermite reaction mixture, and wherein the mass of the additive is between 5 and 45 percent of the mass of the thermite reaction mixture.

Additives may also be present in the thermite reaction mixture which promote the formation of pores in a desired manner when the products of the thermite reaction cool. For example, the thermite reaction mixture is diluted with an additive in the form of a relatively low melt temperature and low viscosity materials promoting the formation of closed pores in the product of the reaction of the thermite reaction mixture. In one embodiment such an additive is silicon dioxide.

In still another aspect, a method of forming a bridge plug within a well is described. The method includes the steps of:

a) lowering the apparatus of the previous paragraphs to a location within the well;

b) igniting the thermite reaction mixture at the location, thereby producing molten thermite reaction products;

c) expanding the thermite reaction products to fill the well through use of gas-generating materials to substantially increase the pore volume of the molten thermite reaction products;

and d) constraining the molten thermite reaction products longitudinally and allowing the molten thermite reaction products to expand substantially only laterally within the well and then allowing the molten thermite reaction products to cool to a solid thereby forming the bridge plug within the well.

In the above method, the step d) can further include the step of allowing the molten thermite reaction products to cool while substantially preventing escape of any gas generated within the molten thermite reaction products.

In another aspect, a method of minimizing lost circulation within a well occurring within a lost circulation zone is disclosed. The method includes the steps of:

a) lowering a reaction package into a well to the location of the zone, the reaction package comprising an elongate cylindrical housing having an upper end and a lower end, a thermite reaction mixture placed within the housing between the upper and lower ends, an upper closure closing off the upper end of the housing and a lower closure closing off the lower end of the housing; and an ignition module in communication with the thermite reaction mixture for triggering a thermite reaction of the mixture;

b) providing with the reaction package gas generating materials;

c) igniting the thermite reaction mixture at the zone, thereby producing molten thermite reaction products;

d) expanding the thermite reaction products to fill the well at the location of the zone through use of the gas generating materials, the materials substantially increasing the pore volume of the molten thermite reaction products, and e) allowing the thermite reaction products to cool.

DETAILED DESCRIPTION

Figure 1:
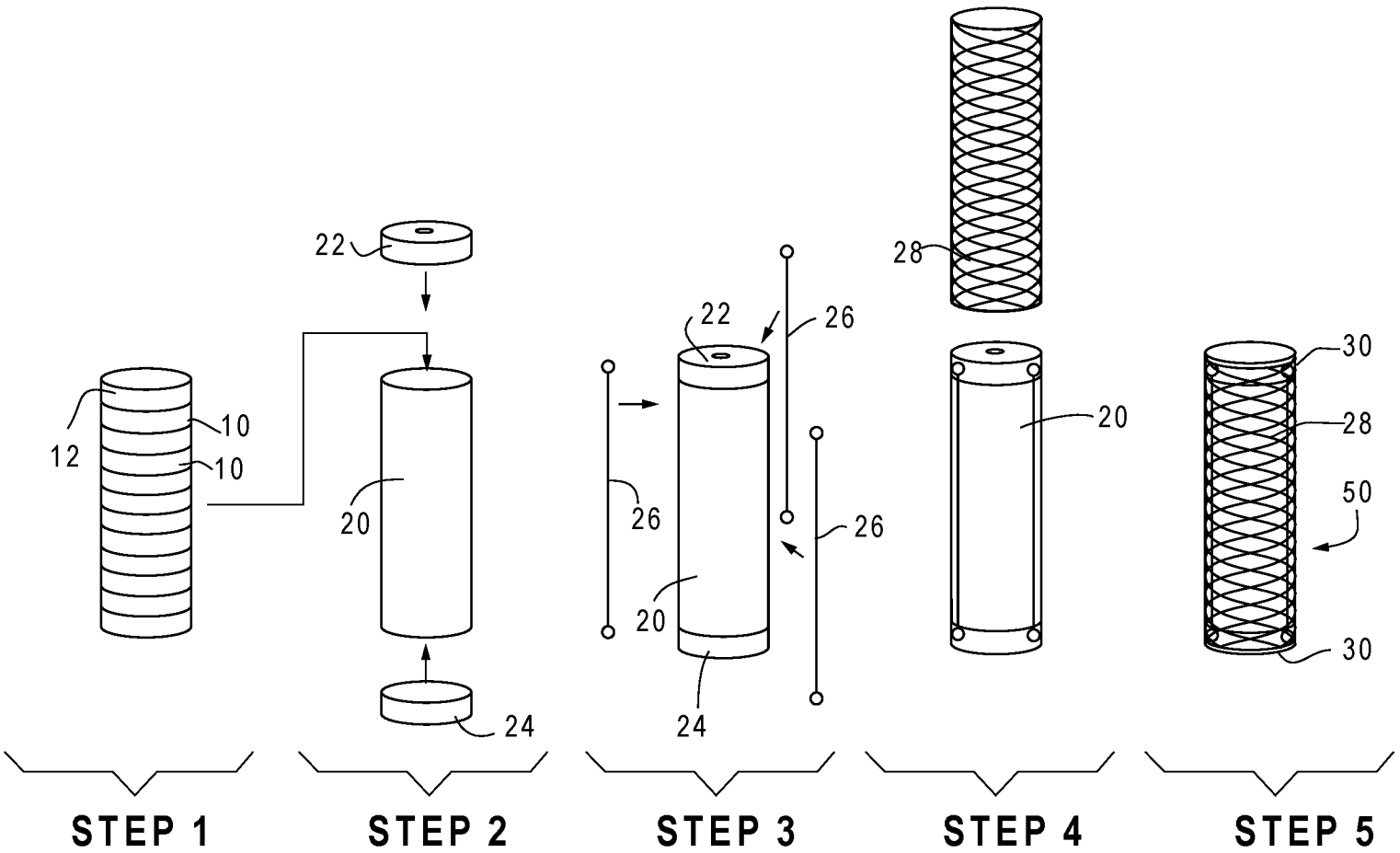
FIG. 1 is an illustration showing a step-by-step method for assembling a downhole thermite reaction package assembly which can be configured or operated to form a bridge plug within a well. The apparatus of FIG. 1 includes both longitudinal stringers and a flexible fiber wrap or sleeve, however it is possible that one or the other could be used and not both.

The configurations in the following description were motivated by a desire to find solutions to a number of different problems which have confounded the art. Hence, this description will offer a more detailed explanation of such problems and issues facing persons skilled in this art and the inventive solutions provided by this disclosure.

Thermite-based technologies offer significant benefits for downhole applications in oil and gas, geothermal, carbon dioxide injection, and waste disposal wells. The technology can deliver a large amount of thermal energy in a relatively small volume, reacts under water in the absence of supplemental air or oxygen, produces little or no off gas, and forms very stable ceramic product materials in addition to its metal product. Furthermore, since its major reaction product is a ceramic, it is well-suited for high temperature and corrosive environments.

Thermites are a class of energetic materials that combine a combustible metal with an oxide to release large amounts of thermal energy. A common formulation is known as "aluminothermite": pure aluminum is the combustible metal and ferric oxide the oxidizer, yielding iron, aluminum oxide, and a large amount of energy:

$$Fe_2O_3+2Al \rightarrow Al_2O_3+2Fe+Heat(3956\ kJ/kg)$$

The reactants are blended in powder form, compacted into the desired shape, and typically ignited with a thermal source. The reaction progresses at a relatively slow pace and is not considered explosive. Aluminothermite is insensitive as an energetic material due to its high activation energy, but once started will tend to react to completion (even under water, since it is self-oxidizing). The stoichiometric aluminothermite reaction reaches a peak temperature of approximately 2900° C. (Theoretical Energy Release of Thermites, Intermetallics, and Combustible Metals, S. H. Fischer and M. C. Grubelich, Sandia National Laboratories, Presented at the Australian-American Joint Conference on the Technologies of Mines and Mine Countermeasures, Sydney Australia, Jul. 12-16, 1999 (SAND99-1170C). Adding materials to alter the reaction and products will reduce the peak temperature, with the practical range of 1500 to 2500° C. being the most likely to successfully propagate the reaction under the downhole conditions.

However, thermite reactions are difficult to manage in the downhole environment if the molten reaction products come in contact with well fluids, as they often do, such as water. The reactions generate molten product material at very high temperature. These interactions in fluid-filled wells can result in highly porous or rubble-like products due to violent thermal/fluid interactions between the molten product and water. This process has been observed in natural settings, for example, when volcanic magma flows into water (Ref. Schipper et. al., *Vapour dynamics during magma-water interaction experiments: hydromagmatic origins of submarine volcaniclastic particles* (*limu o Pele*), Geophys. J. Int. (2013) 192, 1109-1115, and magma-water interactions, Wohletz et. al., *Modeling Volcanic Processes: The Physics and Mathematics of Volcanism*, eds. Sarah A. Fagents, Tracy K. P. Gregg, and Rosaly M. C. Lopes, Cambridge University Press 2012.). The interaction between the high temperature molten magma and water generates hydrodynamic forces that cause the molten material to separate into small rubble particles instead of remaining in monolithic solid form. Higher fluid pressures, as are observed at depth in a well, will reduce the violence of this interaction as the water reaches a super-critical thermodynamic state, but it is difficult to eliminate entirely.

A further effect of water surrounding the reaction product is that water has such a high specific heat capacity so as to rapidly absorb thermal energy from the molten reaction product through thermal conduction, convection, and phase change (if fluid pressure is low enough to allow boiling). The molten product cools rapidly, causing its outer surface to freeze and solidify quickly, forming a rigid shell about the molten product. Under some conditions this may prevent melting of the reactant package (which is necessary for the product to flow out to fill the well).

A further complication is uncontrolled distribution of iron in reaction products, particularly with aluminothermite reactions. In traditional applications of pure (or low dilution) thermite reactions in wells, the reaction products will typically separate in the fluid phase such that the iron product accumulates and settles in the bottom portion of the product mass, due to its high density compared to the ceramic product component. If future drilling out of the plug is anticipated, as is often the case, the iron mass will impede that drilling operation and may require a milling operation to remove. Consequently it may be desirable to control the iron product form so that it is distributed throughout the product mass when solidified, versus accumulated into a large mass.

Prior research has been conducted on so-called ceramic foams. Ceramic foams are a common manufactured industrial product, offering unique mechanical, thermal, and flow properties. They are usually manufactured in a very controlled process of compaction and sintering followed by chemical or thermal dissolution of fillers to create porosity. The Self-propagating High-temperature Synthesis (SHS) process, of which the thermite reaction is a subset, offers the potential of forming high porosity intermetallic or ceramic materials in a single step. The final porosity in this case results from expansion of the initial air-filled porosity of the ingredients, plus additional gas generation during the reaction if vapor-generating material is present. NASA has studied SHS formation of ceramic foam with porosity as high as 90%, as a method of manufacturing near net-shape structural components in low- or zero-gravity environments (SPACE-DRUMS® A Commercial Facility for the ISS, R. Davidson, J. Guigne, D. Hart, International Astronautical Federation, 59th International Astronautical Congress 2008, IAC-08-A.6.B8). This application benefits from the lack of buoyancy effects to produce uniform pore distributions and sizes. In the paper *An assessment of the process of Self-propagating High-Temperature Synthesis for the Fabrication of Porous Copper Composite*, Journal of Alloys and Compounds, November 2009, the authors demonstrated porosity generation with the CuO/Al thermite system, considering the effects of both the initial air-filled porosity in the compacted material prior to the reaction, and porosity developed by gas-generating constituents (using carbon to produce carbon monoxide gas in the reaction). Their tests showed that porosity could be increased four-fold over the initial compact value, with final products of up to 86% porosity. While significant porosity generation was demonstrated, these projects considered porosity enhancements in very low pressure environments. Extending this work to high pressure well environments requires significant modification of the reaction process and products.

In all applications of sealing and flow control apparatus, there are frequently conditions present that pose challenges to the materials and components of the tools, including the presence of high temperatures and corrosive fluids. Traditional cement, metal, and polymer sealing and flow control tools are challenged in high temperature and corrosive applications, as are encountered in geothermal and high pressure/high temperature oil and gas wells. A particularly challenging environment for conventional downhole tool systems is that of uncased boreholes, common in geothermal production wells and occasionally encountered in oil and gas wells. Conventional bridge plugs cannot be deployed in uncased wells to form platforms for cementing or other operations, due to the irregularity of the drilled borehole surface in the absence of well casing. Particularly in geothermal wells where high temperatures and corrosive fluids exist, a ceramic, drillable, highly expandable platform plug is desired to allow well isolation for flow control and potentially as a platform for abandonment materials.

For some well sealing or intervention applications, access to downhole casing may only be available through existing smaller diameter tubing. In those cases, for a thermite plug to be formed in the casing it must be transported in a much smaller diameter package, through the tubing, and then expand significantly when reacted in the casing to be sealed. Lateral expansion ratios as high as 50% may be required, which is difficult with conventional thermite plug systems, existing bridge plugs, or permanent packer technologies. However, the apparatus of this disclosure is suitable for these applications.

First Embodiment: Thermite Reaction Package for Well Applications

FIG. 1 is an illustration showing a step-by-step method for assembling a downhole thermite reaction package assembly which can be configured or operated to form a bridge plug within a well.

In step 1, a thermite reaction mixture 12 is compacted into reactant pucks 10. The thermite reaction mixture may take the forms of the various thermite reaction mixtures known in the art or described in this document, and may preferably be diluted with additives as will be explained in more detail below to either provide gas in the reaction products or for other purposes as will be described. In FIG. 1, a multitude of the reactant pucks 10 are formed.

In step 2, the reactant pucks 10 are placed within a cylindrical housing (typically low melt temperature metal) 20 which is then closed off at the top and bottom with closures, shown as upper and lower end pieces 22 and 24, respectively. The end pieces are fastened or otherwise secured to the upper and lower edges of the housing 20 in any suitable fashion so as to close off the housing 20, and ideally hermetically sealing the housing. Additionally, compressed gas (e.g., nitrogen, air) may be present within the housing prior to the securing of the upper and lower end pieces 22 and 24, in order to provide gas to the thermite reaction and porosity to the resulting reaction products and promote lateral expansion of the products, as will be explained below.

In step 3, a set of two or more, preferably 3 or more such as 4, 5, or 6 elongate, high temperature, rigid stringers or structures 26 are fasted to the upper and lower end pieces equidistantly spaced around the housing. The stringers 26 are provided to constrain the thermite reaction products from expanding longitudinally and to promote expansion of the thermite reaction products laterally outwardly, i.e., against the wall of the well bore.

In step 4, a heat resistant, flexible fiber sleeve, such as a ceramic or glass fiber wrap 28 is placed over the cylindrical housing 20 so as to surround the housing 20 and the stringers 26.

In step 5, the ceramic or glass fiber sleeve 28 is clamped to the housing using clamps 30. It is possible to wrap the housing 20 with the flexible sleeve 28 prior to installation of the stringers 26. The sleeve 28 serves to also prevent expansion of the thermite reaction products in the longitudinal direction and promote expansion in the lateral or radial direction. The sleeve 28 also serves to promote adhesion of the thermite reaction products against the wall of the wellbore.

Note that in FIG. 1 an igniter for the thermite reaction mixture is provided, but is not shown. The igniter, conventional and known in the art, will be typically present either in the bottom or top of the cylindrical housing or adjacent to it on the outside of the lower end piece 24 so as to trigger the reaction of the thermite reaction products in the reactant pucks 10. Additionally, the temperature of the thermite reaction will ordinarily be sufficient to completely melt both the housing and the stringers 26, but by making the stringers 26 of a high melt temperature material (e.g., ceramic or suitable metal such as tungsten), the stringers will be able to provide the function of substantially preventing the longitudinal expansion of the thermite reaction products for a sufficient amount of time after the reaction commences so as to promote the lateral expansion of the thermite reaction products laterally outwardly against the well wall.

Figure 2:
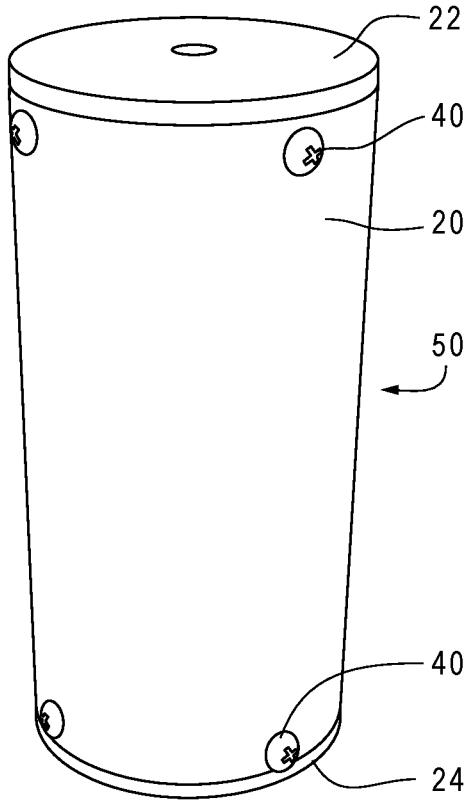
FIG. 2 is a perspective view of a reaction package of FIG. 1 containing the thermite reaction mixture and showing the upper and lower closures or end caps.

FIG. 2 is a perspective view of a thermite reaction package 50 assembled in accordance with FIG. 1 at the completion of Step 2. The upper and lower end caps 22 and 24 are secured to the housing 20 by means of adhesives or fasteners 40. In this embodiment the reaction package 50 is hermetically sealed and pressurized with gas to as to promote a desired porosity of the reaction products when they have cooled.

Figure 3:
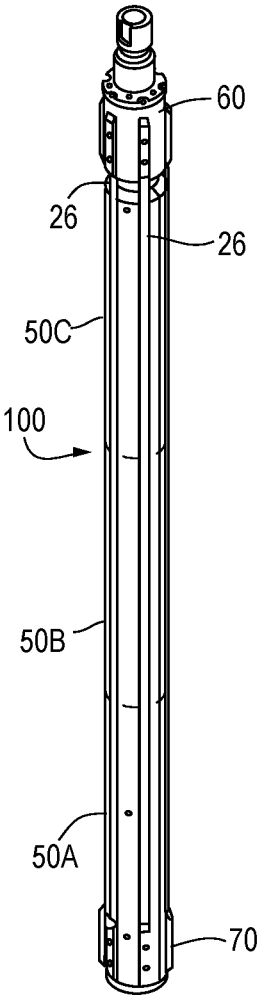
FIG. 3 is a perspective view of a reaction package having an elongate configuration showing a crossover to the emplacement system at the upper end thereof and an ignition module at the lower end of the reaction package for igniting the thermite reaction mixture. The ignition module could be placed anywhere in the package if required. The embodiment of FIG. 3 features a set of four equidistantly placed high temperature stringers connecting the upper and lower closures of the reaction package, or adjacent structures, to promote lateral expansion of the thermite reaction products.

FIG. 3 is a perspective view of a downhole thermite reaction device 100 in the form of three reaction packages 50A, 50B, 50C (of the design of FIGS. 1 and 2) placed end to end between a tool string crossover 60 at the upper end thereof and an ignition module 70 at the lower end which is provided for igniting the thermite reaction mixture within the lowermost reaction package 50A. The crossover 60 is a conventional interface for lowering the device 100 within a well. Once the thermite reaction is triggered in the reaction package 50A by the ignition module 70 the reaction progresses upwards through the assembly to ignite reaction packages 50B and 50C. In the embodiment of FIG. 3 there are a set of four equidistantly placed high temperature stringers 26 which serve to prevent longitudinal expansion of the thermite reaction products and promote lateral expansion. The glass or ceramic wrap 28 of FIG. 1 is omitted from this Figure in order to better show the remaining structures.

In one variation, instead of three separate reaction packages 50A, 50B and 50C there could be a single reaction package 50 as shown in FIG. 2 but sized in a substantially elongate configuration as shown in FIG. 3.

Figure 4:
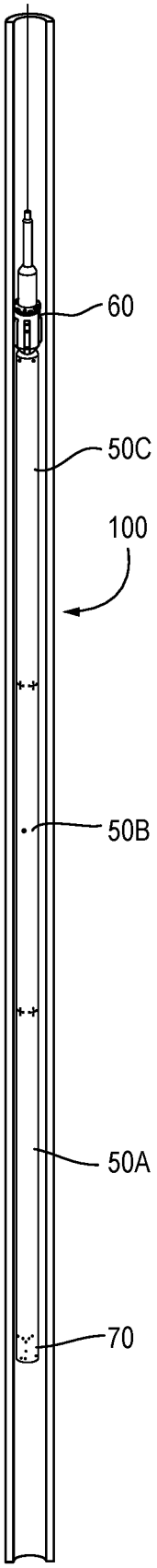
FIG. 4 is a view of the apparatus of FIG. 3 placed within a well, in which the apparatus is configured with three reaction packages similar to that shown in FIG. 2.

FIG. 4 is a view of the device 100 of FIG. 3 placed within a well, in which the device 100 is configured with three reaction packages similar to that shown in FIG. 2. The glass or ceramic wrap 28 of FIG. 1 is also omitted from this Figure in order to better show the remaining structures.

Figure 5:
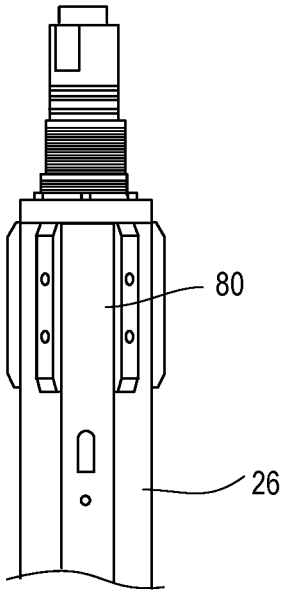
FIG. 5 is a more detailed view of the crossover module of FIGS. 3 and 4.

FIG. 5 is a more detailed view of the crossover 60 of FIGS. 3 and 4. In this embodiment there are six stringers 26 equidistantly spaced around the device 100.

Figure 6:
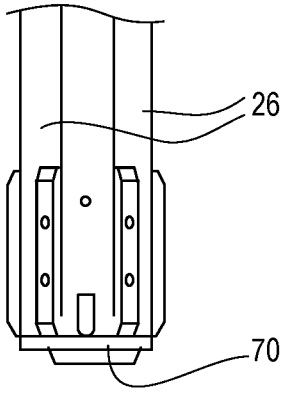
FIG. 6 is a more detailed view of the ignition module of FIGS. 3 and 4.

FIG. 6 is a more detailed view of the ignition module of FIGS. 3 and 4. The stringers in this configuration are fastened to the crossover 60 and the ignition module 70 but serve the same purpose as explained previously. FIG. 6 also shows the presence of centralizers, which serve to maintain the package in the center of the hole and prevent abrasive damage to the package during emplacement.

Figure 7:
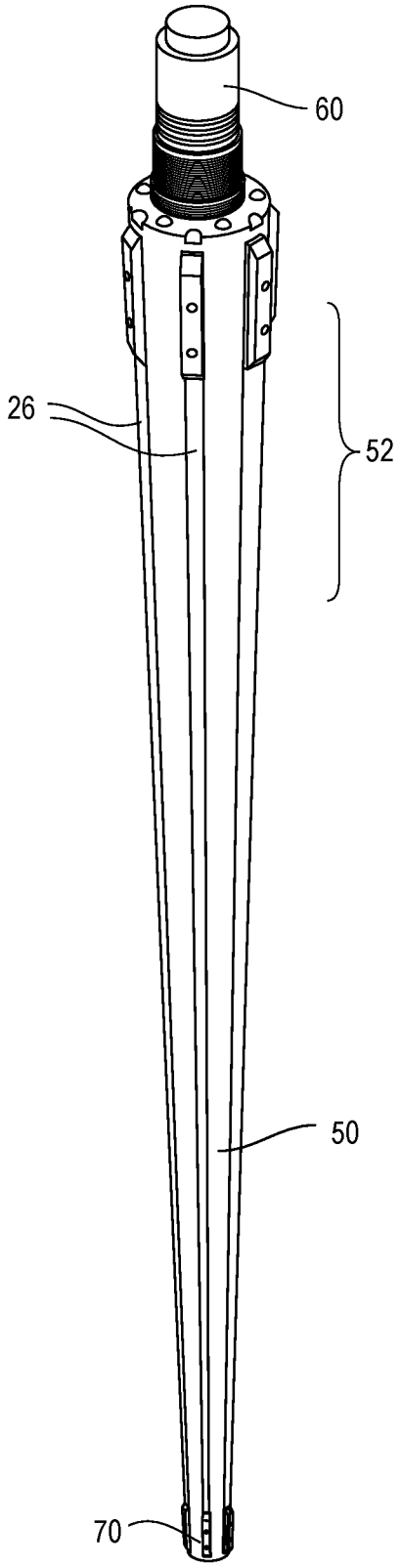
FIG. 7 is another perspective view of the apparatus of FIG. 3 prior to insertion into a well.

FIG. 7 is another perspective view of the device 100 of FIG. 3 prior to insertion into a well. In this embodiment there is a single elongate reaction package 50 packed with thermite reactant pucks 10 (FIG. 1); additionally the interior of the upper region 52 of the reaction package 50 is provided with a gas generating means, such as compressed gas or a pressure balancing system to add gas into the thermite reaction products when downhole. The glass or ceramic wrap 28 of FIG. 1 is omitted from this Figure in order to better show the remaining structures.

Figure 8A:
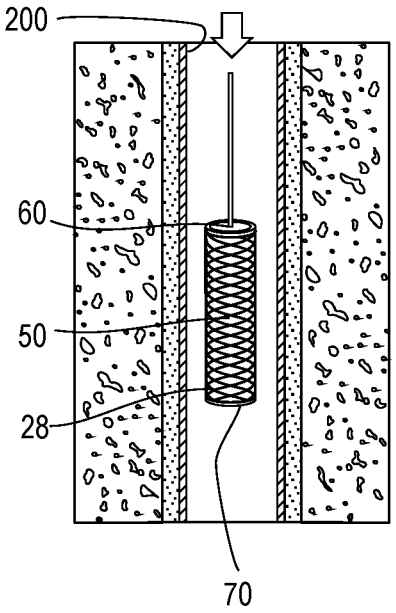
FIGS. 8A-8C show a method of forming a ceramic "packer" or bridge plug within a cased well; the method is similar for an uncased well.
Figure 8B:
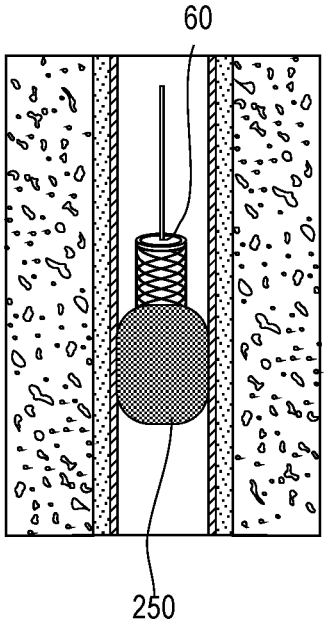
Figure 8C:
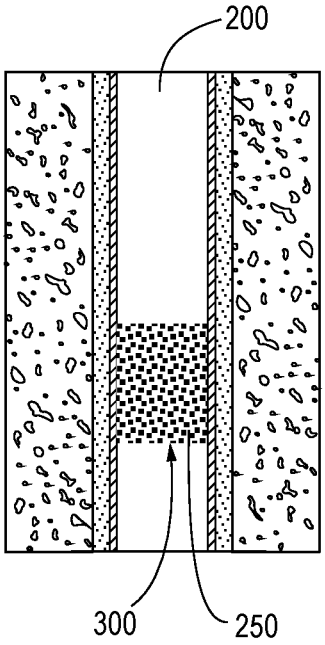

FIGS. 8A-8C show a method of forming a ceramic "packer" or bridge plug within a cased well using the device of FIGS. 3-7; the method is similar for an uncased well. The formation of the bridge plug in accordance with FIG. 8 allows for the subsequent cementing in upper regions of the well for plugging and abandonment or formation of sealing plugs in accordance the prior patents of the assignee Olympic Research, Inc. cited previously in this document. The method of FIG. 8 is particularly attractive for uncased wellbores where bridge plugs are not currently used. In FIG. 8A a reactant package 50 (which, in practice may take the form of the device of FIGS. 3-7 including the ignition module 70) is lowered to a target depth within a well 200 on a wireline or other suitable emplacement system. The package includes the optional flexible ceramic or glass wrap 28 (FIG. 1). The thermite reaction is triggered by the ignition module 70 and in FIG. 8B the reaction products 250 expand laterally outwardly to fill the well 200, at a reaction rate fast enough to not drain into the well below. In FIG. 8C, the reaction has run to completion and the reaction products 250 have cooled, forming a porous bridge plug 300 in place within the well 200.

Figure 12A:
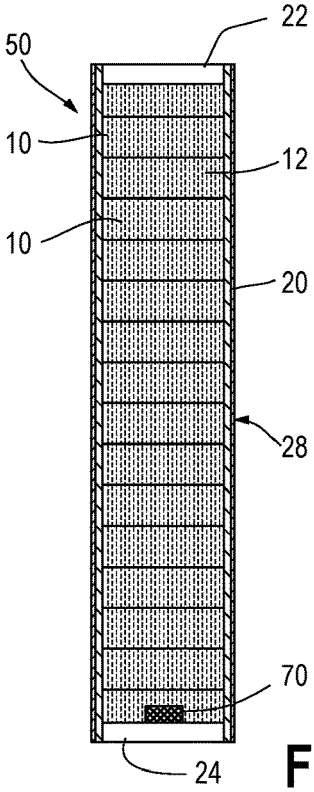
FIG. 12A is a cross-section through a reaction package constructed per FIGS. 1-4.
Figure 12B:
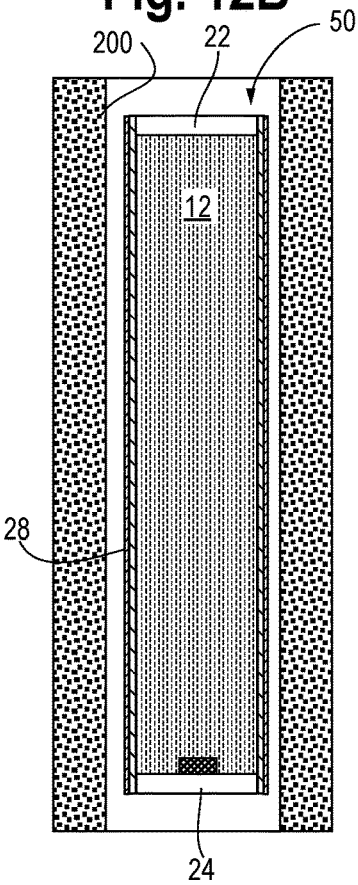
FIGS. 12B-12D is another view similar to FIGS. 8A-8C showing the process of initiating the thermite reaction in the package and forming a plug in the well.
Figure 12C:
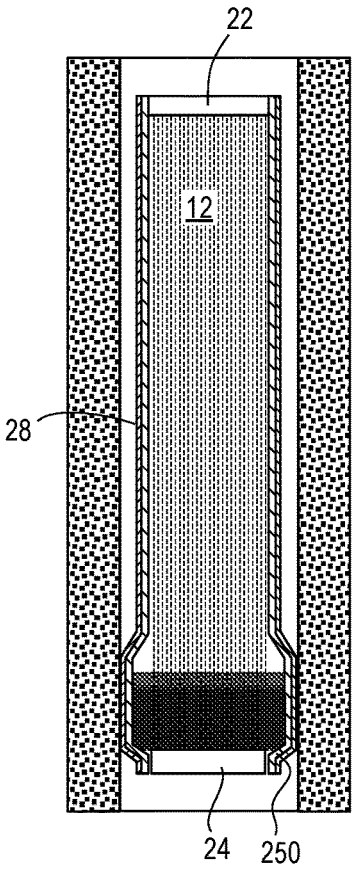
Figure 12D:
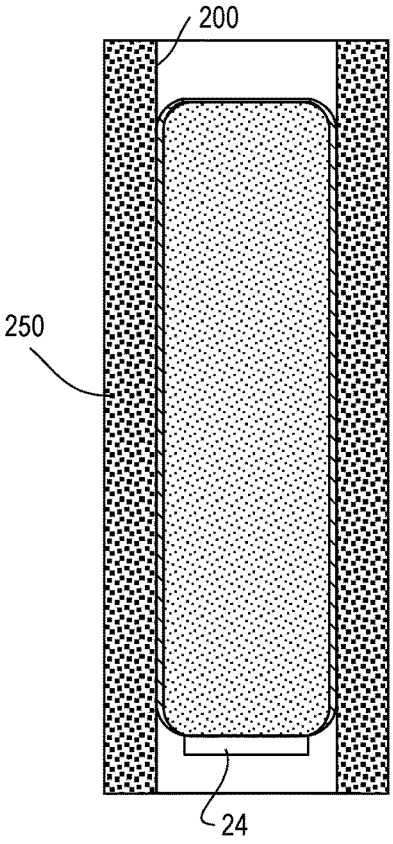

FIG. 12A is a cross-section through the reaction package 50 and FIGS. 12B-12D is another view similar to FIGS. 8A-8C showing the process of initiating the thermite reaction and forming a plug in the well.

Having described the apparatus and methodology in some detail, the following discussion will address carefully chosen reaction additives to the thermite reaction mixture (present in the pucks 10 of FIG. 1) that control the molten product rheology, solidification temperature, pore generations and sustainment, and prevention of accumulation of a solid iron mass within the bridge plug.

A thermite-based plug can be formed in a cased or uncased well by reacting a modified thermite package while suspended from a wireline as shown in the Figures and explained above. The thermite material is engineered to expand in volume and fill the well, as shown in FIGS. 8A-8C and 12B-D. The expanding material is restrained between the top and bottom end caps 20, 22 (FIG. 1) of the package 50 by either being wrapped in a heat-resistant flexible expanding fabric (like biaxially woven or braided glass or ceramic fiber, 28 in FIG. 1) or rigid, high temperature stringers 26 that connect the top and bottom caps to each other (or adjacent structures as in FIG. 7), or a combination of the two.

A. Method of Generating and Maintaining Thermite Product Expansion with Gas Generating Materials Typical thermite reactions are considered gasless, because the stoichiometric reaction does not produce non-condensable gas as a byproduct. However, the thermite material typically retains some gas in its pore spaces (since it is usually packaged as loose or compacted powder or granule material). When the thermite reaction occurs, it will raise the temperature from the ambient downhole temperature (100-200° C.) to as much as 2500° C. or more, expanding the gas in its pores according to the ideal gas law. Hence, in one configuration, when the pucks 10 of FIG. 1 are formed they are formed with the addition of gas mixed in with the thermite reaction mixture.

An alternative method of expanding the pores in the product material (250 in FIG. 8C) is to add an additive in the form of solid material to the thermite mixture which changes to vapor at the elevated reaction temperatures. One such method is a reduction/oxidation reaction which generates gas as a product of the reaction. Elemental carbon and an oxidizer (such as iron oxide) will react at elevated temperatures to produce CO and $CO_2$ gas. Many other redox combination additives are possible. A second chemical method of expanding the pores is thermal decomposition. Calcium carbonate, for example ($CaCO_3$) will decompose when heated to approximately 860° C. to yield $CO_2$ (gas) and CaO (solid/liquid).

Countering this is the effect of the ambient fluid pressure in the well, which will resist the pore expansion. This is governed by the ideal gas law:

$$pV=nRT \qquad \text{Equation 1}$$

Where p=absolute pressure, V=volume, n=number of moles, R=universal gas constant, T=absolute temperature). For expansion of a fixed mass (fixed number of moles) of gas such as the existing gas in a pore space, this equation can be simplified so the change in volume is expressed as $$V_{final}/V_{initial}=(T_{final}\times P_{initial})/(T_{initial}\times P_{final}) \qquad \text{Equation 2}$$

Under ambient pressure conditions at the surface of the earth, the initial and final pressures are essentially equal. Expanding the gas in the pores will achieve a pore expansion proportional to the final/initial absolute gas temperature. Raising the pore gas from 100° C. (373° K) to 2500° C. (2773° K) will expand the pore volume by 2773/373=7.4 times.

However, if this reaction occurs under pressure in the downhole environment, the expansion is resisted by the downhole pressure. The pore gas is generally under atmospheric pressure condition when packaged, and remains so until reacted because its packaging resulting from FIG. 1 procedure is preferably hermetic. The downhole pressure is dependent on the depth in the well, the density of the well fluid, existing fluid pressure effects from adjacent fluid reservoirs, and any additional pressure applied at the surface. In a typical oil well the downhole pressure could be, for example, 20.68 MPa (3000 psi) compared to the initial pressure of 0.1 MPa (14.5 psi). Using equation 1 and considering the gas contained in the pores, and the same temperature rise (373° K to 2773° K), the volume change is significantly reduced due to the overpressure $$V_{final}/V_{initial}=(2773*0.1)/(373*20.68)=0.036 \qquad \text{Equation 3}$$

Consequently, while significant volume expansion of pore gas can be achieved in a thermite reaction under ambient conditions, high pressures at depth will compress the pore gas to significantly lower volume. Additional moles of gas are needed to achieve similar expansion at depth under great pressure.

The additional moles required to sustain or increase pore volume are also calculated by the ideal gas law (eq 1), considering the desired volume change ($V_f/V_i$) and the temperature and pressure conditions.

$$n2/n1=(T_{initial}\times P_{final})/(T_{final}\times P_{initial}) \quad \text{Equation 4}$$

It can be seen that, given the typical temperature change due to the thermite reaction as noted above, to preserve the initial volume of the pores ($V_f/V_i=1$) and prevent reduced porosity of the products, additional moles of gas are required:

$$n2/n1=(373*20.68)/(2773*0.1)=27.82 \text{ times the original moles of pore gas}$$

Such additional moles of gas can be provided in several ways: a) they can be provided by pressurizing the thermite reactant with additional gas when packaged (i.e., during the process of FIG. 1), b) by including more gas, e.g., compressed air or nitrogen, within the package 50, c) by incorporating a mechanism to add gas to the package 50 when in the well using a pressure balancing system positioned in communication with the interior of the package 50, and/or d) adding to the thermite reaction mixture additives in the form of reactant materials that will generate gas due to the elevated reaction temperatures.

The mass of gas-generating material required is readily calculated using the molar mass of the additive and the number of moles required per Equation 4. It is important to consider the equation of state of the particular gas generated by chemical reactant means. For example, calcium carbonate will degrade to generate carbon dioxide gas. Carbon dioxide is super critical at pressures above 7.39 MPa (1071 psi), meaning that it will not exist in a distinct vapor state above that pressure and cannot support continued expansion of the pores according to the ideal gas law. Consequently, other gas generating materials that will generate, for example, nitrogen gas or other non-condensable gas, may be used for very high pressure well environments.

B. Method of Retaining the Pore Gas in the Product when it Solidifies

Pore gas expansion will yield the desired expanding plug final form only if it is retained in the thermite reaction product as it cools and solidifies, which is desired in the methods and apparatus of this disclosure. Consequently, the product viscosity vs. temperature relationship must be tailored to retain the pore 'bubbles' in the product until they are effectively frozen in position, otherwise they will float up to the top of the molten product mass.

This can be accomplished through use of additives to the thermite reaction mixture with specific particle size and melt temperature. A high melt temperature material like silicon carbide (SiC) (melt temperature 2730° C., well above the typical thermite reaction temperature) provides thermal mass to absorb thermal energy from the molten product and cause it to cool and solidify quickly, freezing gas bubbles in place. Since it stays in its solid phase, SiC can also act to increase the molten product viscosity by the well-known process similar to adding powders to liquids as thickeners. Other additives, like aluminum oxide, silicon dioxide, and minerals with lower melt temperatures, may melt and chemically adjust the viscosity of the melt to assist retention of the bubbles. These materials can be added in the range of 5% to 45% by mass to reach the desired product forms.

The nature of the solidified porous product can be further modified to favor connected vs. disconnected porosity, which influences the permeability of the final product to fluid flow. For example, using higher melt temperature additives like silica or alumina will result in more connected porosity, while lower melt temperature additives like glass or calcium metasilicate will tend to fuse together and close the pores to fluid flow. Such control is desired in well screen applications, for example, where fluid flow is desired through the porous screen while sand particles are filtered by the screen. See the description of FIGS. 9A-9D below.

C. Control of Distribution of Iron Products Resulting from Aluminothermite Reactions An additional benefit of the high melt temperature additives is to control the distribution of iron in the reaction products. If SiC is added in sufficient quantity (5% to 30% or more by mass) and particle size distribution (600 mesh to as large as 30 mesh) to the thermite reaction mixture, it will prevent the iron product from agglomerating and forming large masses of iron in the product. Instead, the iron quickly solidifies in place and is distributed throughout the product form, which is much more favorable for subsequent drilling operations, if required.

D. Packaging Considerations

In order for the expanding plug (FIG. 8C) to form at the desired location in the well, the reaction has to be contained such that it can expand laterally and the reaction products remain at the desired location in the well. During the reaction the products are in a somewhat fluid form, and will drop or flow down the well if not contained. One preferred approach for containing the reaction products is to surround the thermite package with glass or ceramic fiber wrap material (28, FIG. 1) that allows expansion while containing the products. As explained in the embodiments of FIGS. 1 and 2, the reactant package 50 is centered between end pieces above and below. A plurality of retaining rods or straps 26, of a high melt temperature material such as ceramic or metal, affix the top and bottom end pieces 22 and 24 in constant relative position, such that when the reaction occurs and the reaction product material expands, it can expand only laterally. High temperature steel, tungsten, or ceramic rods or ribbons can form this function as as the stringers 28. Further, the expanding product is contained within a layer of flexible woven or braided fabric-like material (28, FIG. 1, FIG. 8A) wrapped over the retaining stringers 26 and reactant package 50 and clamped to the end pieces, made of a relatively high melt temperature material to withstand the heat of the reaction. Biaxially woven or pleated fabrics will allow expansion up to the point when they are pressed up against the borehole wall. It may be favorable to choose fabric that will then melt and assist formation of a mechanical or sealing bond at the interface between the reactant products and the tubing, casing, or borehole rock material.

A further benefit of the outer wrap 28 of fibrous high temperature material is to reduce heat losses from the reaction products so they will deform and flow to fill the well or other enlargement. By insulating the outer surface of the reactant reaction package the molten product material will remain at a higher temperature, and hence remain fluid longer, than if in direct contact with the well fluid.

Second Embodiment: Screens

In uncased boreholes, it is also frequently desirable to screen regions of the borehole to allow product or geothermal fluids entry into the well but prevent flow of loose materials such as sand. In high temperature or corrosive fluid environments, this screen must also have high service temperature and corrosion resistance, conditions which challenge metal screen materials. A goal is to emplace the porous thermite reacted mass in a defined production zone, and then drill a hole through the porous cylindrical mass to form an annular structure which allows drill or well tooling to be inserted through the hole, but leaving the annular screen in place. It is possible to have the screen permeable, for example to achieve a target of 10-150 Darcy permeability to match with the formation transmissivity. It is also possible to control the pore size to act as a filter.

This second embodiment is directed to forming a sand control screen within a well, using the techniques of Example 1. The methodology is shown in FIGS. 9A-9D.

Description of emplacement and formation process is as follows:

Step 1: form a long porous 'plug' in accordance with Example 1. See FIG. 9A: reactant package 50 is lowered to target depth on a wireline; the thermite reaction is triggered and the reactant products 250 (porous, due to the gas generating features described previously) expand to fill the well as shown in FIG. 9B.

Figure 9A:
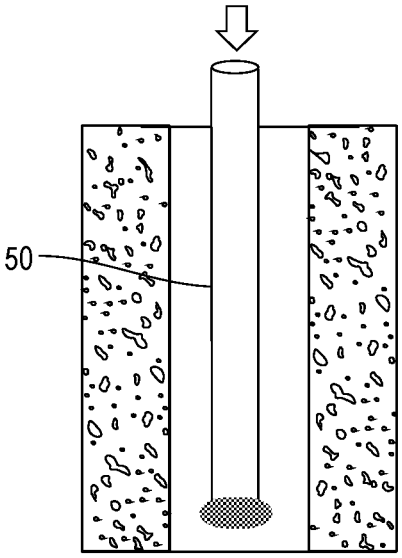
FIGS. 9A-9D show a method for forming a screen for flow and sand control using the apparatus of FIGS. 3-7.
Figure 9B:
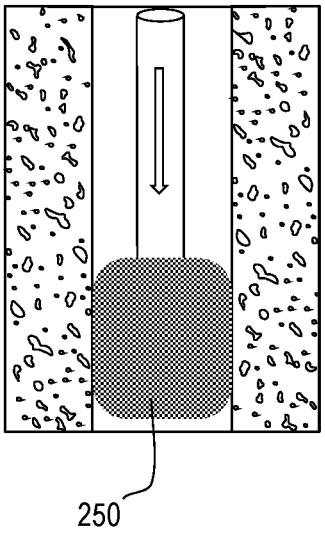
Figure 9C:
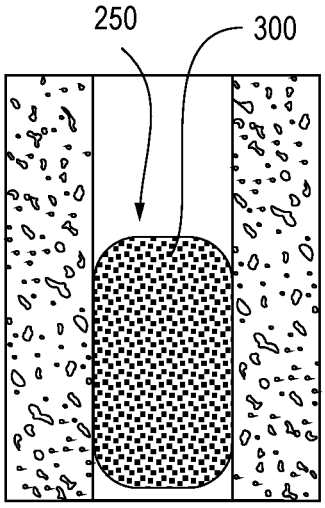

Step 2: let the reactant products 250 formed in Step 1 cool and solidify to form a plug 300. In FIG. 9C, the reactant products 250 are allowed to cool to ambient temperatures, typically in less than 24 hours.

Figure 9D:
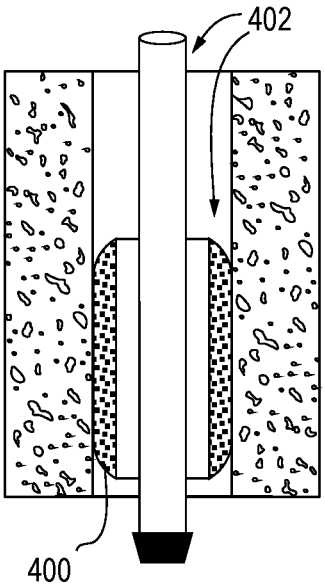

Step 3: drill a hole through the plug 300 of FIG. 9C to form a screen 400, see FIG. 9D. As shown in FIG. 9C, the center is drilled out which thereby forms a porous screen 400 peripheral to the central hole; well tooling 402 has been inserted into the well through the hole, the details of which are not important.

Figure 10:
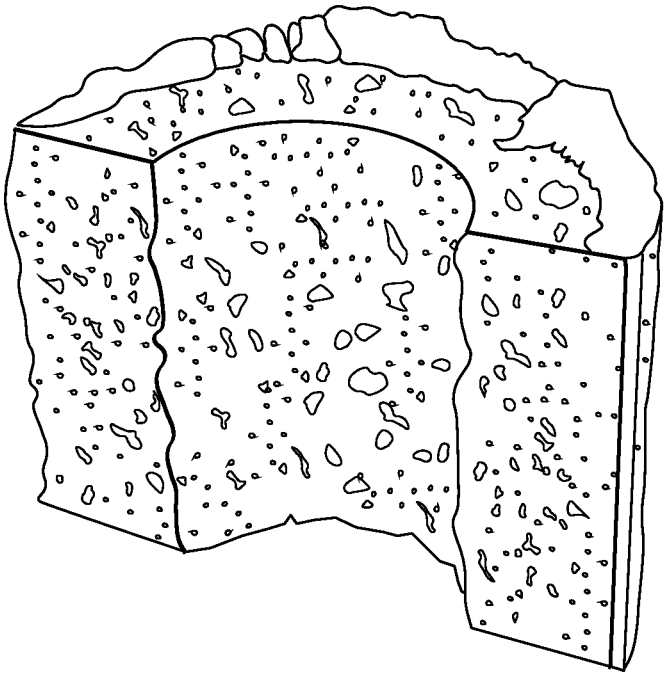
FIG. 10 shows a cross-section of the ceramic screen formed in accordance with the methodology of FIG. 9, illustrating the porosity of the screen.

FIG. 10 shows a cross-section of the ceramic screen formed in accordance with the methodology of FIG. 9, illustrating the porosity of the screen Third Embodiment: Lost Circulation Control When wells are drilled, the operation occasionally encounters a lost circulation zone, where the rock surrounding the drill bit is sufficiently permeable to cause drainage of the drilling fluids into the surrounding rock, and prevent circulation of the these fluids back to the surface. Under these circumstances the drill is at risk because the operators cannot know if the drill bit is being lubricated by the fluid, and cuttings are no longer brought to the surface and may consolidate around the drill string. A variety of materials can be pumped down through the drill bit in an attempt to plug the formation. If this is not successful, the drill string will be removed from the borehole and cement pumped to the bottom of the hole in an attempt to fill up cavities or pores that cause the lost circulation. If successful, the drilling operation proceeds through the cemented zone. Cementing is time-consuming (due to the required set time of the cement), expensive, and frequently unreliable, because the cement may flow through the lost circulation zone indefinitely. Instead of pumping cement to depth, it would be desirable instead to emplace a tool which expands to form a rapidly solidifying plug at the bottom of the hole, sealing the lost circulation voids, and allowing drilling to continue. This is achieved by this third embodiment.

In particular, this third embodiment is directed to methods for borehole stability and prevention of lost circulation. This embodiment includes the placement and formation of a plug produced from a thermite reaction at bottom of a well to stabilize borehole rock, seal against drilling fluid loss, and allow continued drilling through the plug.

Generally, the package and thermite formulation for the lost circulation application would be the same for the other applications described above, and preferably includes features for gas generation, prevention of escape of gasses, and prevention of formation of large iron masses with alumino-thermite mixtures. The one possible difference could be that for the lost circulation application, since it will likely be set on the bottom of the well, the package will not need the stringers 28 in all cases. It will preferably still use the fiber wrap to control heat losses, and the thermite mixture will have gas generation, iron control, and other features.

FIG. 11A-11D show one example of the process for lost circulation control.

Figure 11A:
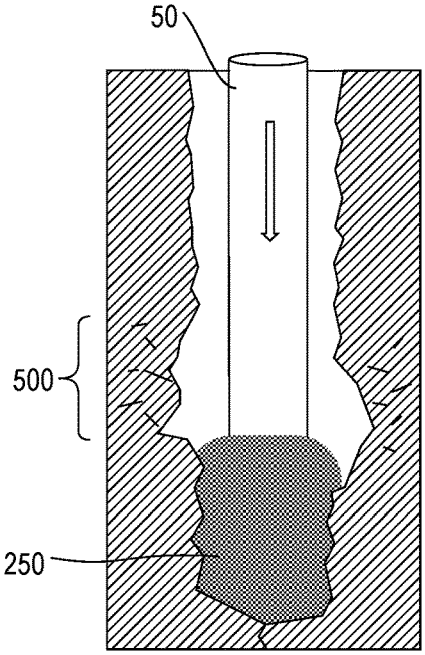
FIGS. 11A-11D are an illustration of a method for lost circulation control.
Figure 11B:
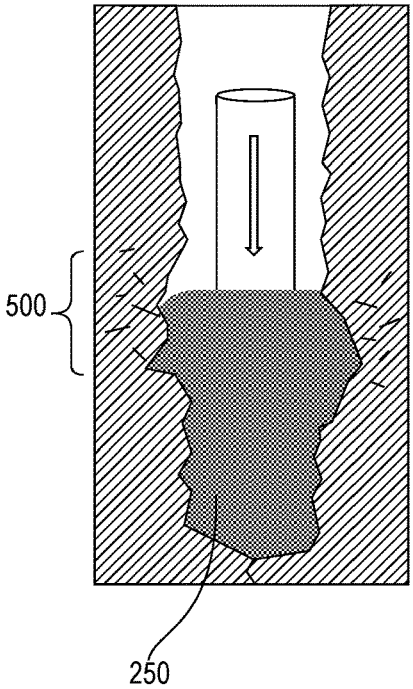
Figure 11C:
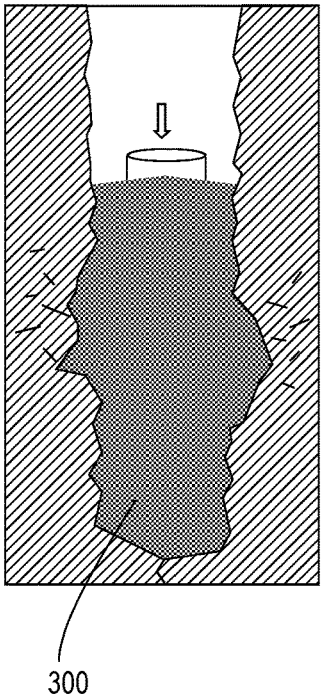

Step 1: a thermite reaction package 50 is lowered to a zone 500 in which lost circulation is occurring, typically the bottom of a well. The package is then ignited as shown in FIG. 11A.

Step 2: The reaction products 250 expand outwardly and fill the borehole, and solidifies quickly to prevent flow of the thermite reaction products into fractures in the rock formation. See FIGS. 11B and 11C.

Figure 11D:
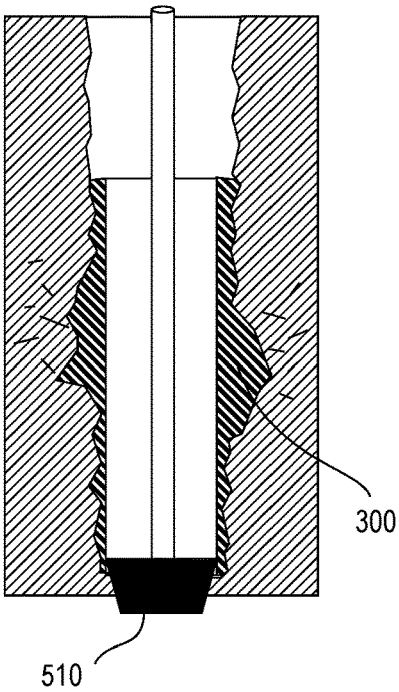

The process can continue with step 3:

Step 3: As shown in FIG. 11D, after the reaction products have cooled, a plug 300 formed in place at the zone 500 which seals off the cracks in the formation in the zone 500 and a drill 510 is inserted into the bore hole and operated to drill a central hole through the plug 300 and continuing deeper as desired by the drilling operation with the desired circulation of drilling fluids.

In summary, a method of minimizing lost circulation within a well occurring within a lost circulation zone (500) having lost circulation flow paths (e.g., cracks or openings in the rock formation) is contemplated which includes the following steps:

a) lowering a reaction package (50) into a well to the location of the zone (500), the reaction package in the form of an elongate cylindrical housing (FIG. 1) having an upper end and a lower end, a thermite reaction mixture (10, FIG. 1) placed within the housing between the upper and lower ends, an upper closure closing off the upper end of the housing and a lower closure closing off the lower end of the housing (FIGS. 1, 2); and an ignition module (70, FIG. 3) in communication with the thermite reaction mixture for triggering a thermite reaction of the mixture;

b) providing with the reaction package gas generating materials, see the previous discussion;

c) igniting the thermite reaction mixture at the zone, thereby producing molten thermite reaction products;

d) expanding the thermite reaction products to fill the well at the location of the zone through use of the gas generating materials, the materials substantially increasing the pore volume of the molten thermite reaction products (see FIGS. 11B and 11C), and e) allowing the thermite reaction products to cool and seal the lost circulation flow paths.

The appended claims are provided as further descriptions of the disclosed inventions. All questions concerning scope are to be answered by reference to the appended claims.

What is claimed is:

1. Apparatus for forming a platform within a well, comprising in combination:

a) an elongate cylindrical housing having an upper end and a lower end;

b) a thermite reaction mixture placed within the housing between the upper and lower ends;

c) an upper closure closing off the upper end of the housing and a lower closure closing off the lower end of the housing;

d) an ignition module in communication with the thermite reaction mixture for triggering a thermite reaction of the mixture; and e) wherein the apparatus is configured with a structure extending axially along the length of the cylindrical housing between the upper and lower closures substantially preventing longitudinal expansion of products of the thermite reaction and promoting lateral expansion of the products of the thermite reaction, wherein the structure connects the upper and lower closures or structures adjacent thereto, said at structure extending axially along the length of the cylindrical housing, and wherein the cylindrical housing is made from a relatively low temperature material such that it is consumed during the thermite reaction.

2. The apparatus of claim 1, further comprising gas generating materials within the cylindrical housing, wherein the cylindrical housing is hermetically sealed promoting retention of gas generated by the reacting materials within the housing.

3. The apparatus of claim 2, wherein the gas generating materials comprise reactants placed within the thermite reaction mixture.

4. The apparatus of claim 2, wherein the gas generating materials comprise pressurized gas added to the thermite reaction mixture.

5. The apparatus of claim 2, wherein the gas generating materials comprise pressurized air present within the cylindrical housing between the upper and lower closures.

6. The apparatus of claim 1, wherein the thermite reaction mixture is diluted with an additive comprising relatively low melt temperature and low viscosity materials promoting the formation of closed pores in the product of the reaction of the thermite reaction mixture.

7. The apparatus of claim 6, wherein the additive comprises silicon dioxide.

8. Apparatus for forming a platform within a well, comprising in combination:

a) an elongate cylindrical housing having an upper end and a lower end;

b) a thermite reaction mixture placed within the housing between the upper and lower ends;

c) an upper closure closing off the upper end of the housing and a lower closure closing off the lower end of the housing;

d) an ignition module in communication with the thermite reaction mixture for triggering a thermite reaction of the mixture; and e) wherein the apparatus is configured with a structure for substantially preventing longitudinal expansion of products of the thermite reaction and promoting lateral expansion of the products of the thermite reaction, wherein the structure comprises a heat resistant, flexible expanding fiber surrounding the cylindrical housing.

9. The apparatus of claim 8, further comprising one or more clamps clamping the flexible expanding fiber against the cylindrical housing.

10. The apparatus of claim 8, wherein the flexible expanding fiber comprises a glass or ceramic fiber.

11. Apparatus for forming a platform within a well, comprising in combination:

a) an elongate cylindrical housing having an upper end and a lower end;

b) a thermite reaction mixture placed within the housing between the upper and lower ends;

c) an upper closure closing off the upper end of the housing and a lower closure closing off the lower end of the housing;

d) an ignition module in communication with the thermite reaction mixture for triggering a thermite reaction of the mixture; and e) wherein the apparatus is configured with a structure for substantially preventing longitudinal expansion of products of the thermite reaction and promoting lateral expansion of the products of the thermite reaction, wherein the structure comprises a set of three or more rigid, high temperature resistant stringers equidistantly spaced around the cylindrical housing.

12. The apparatus of claim 11, further comprising a glass or ceramic fiber wrap surrounding the cylindrical housing.

13. Apparatus for forming a platform within a well, comprising in combination:

a) an elongate cylindrical housing having an upper end and a lower end;

b) a thermite reaction mixture placed within the housing between the upper and lower ends;

c) an upper closure closing off the upper end of the housing and a lower closure closing off the lower end of the housing;

d) an ignition module in communication with the thermite reaction mixture for triggering a thermite reaction of the mixture; and e) wherein the apparatus is configured with a structure for substantially preventing longitudinal expansion of products of the thermite reaction and promoting lateral expansion of the products of the thermite reaction, and f) gas generating materials within the cylindrical housing, wherein the gas generating materials comprise a pressure balancing system placed within or adjacent to the cylindrical housing.

14. Apparatus for forming a platform within a well, comprising in combination:

a) an elongate cylindrical housing having an upper end and a lower end;

b) a thermite reaction mixture placed within the housing between the upper and lower ends;

c) an upper closure closing off the upper end of the housing and a lower closure closing off the lower end of the housing;

d) an ignition module in communication with the thermite reaction mixture for triggering a thermite reaction of the mixture; and e) wherein the apparatus is configured with a structure for substantially preventing longitudinal expansion of products of the thermite reaction and promoting lateral expansion of the products of the thermite reaction, and wherein the thermite reaction mixture is diluted with an additive promoting the retaining of gas within the products of the thermite reaction when it solidifies.

15. The apparatus of claim 14, wherein the thermite reaction mixture has a reaction temperature, and the additive comprises a material having a substantially higher melting temperature than the reaction temperature.

16. The apparatus of claim 15, wherein the additive comprises silicon carbide or other similar high melt temperature material.

17. The apparatus of claim 16, wherein the thermite reaction mixture comprises an iron oxide and aluminum thermite reaction mixture and wherein the silicon carbide is present in a sufficient amount and of a particle size that it prevents iron products from agglomerating and forming large masses of iron in the products of the thermite reaction.

18. The apparatus of claim 14, wherein the thermite reaction mixture has a reaction temperature, and wherein the additive is selected from the group consisting of aluminum oxide, silicon dioxide, and minerals with a lower melt temperature than the reaction temperature, and wherein the mass of the additive is between 5 and 45 percent of the mass of the thermite reaction mixture.

19. A method of forming a structure within a well, comprising the steps of:

a) lowering a device to a location within the well, the device comprising 1) an elongate cylindrical housing having an upper end and a lower end; 2) a thermite reaction mixture placed within the housing between the upper and lower ends; 3) an upper closure closing off the upper end of the housing and a lower closure closing off the lower end of the housing; 4) an ignition module in communication with the thermite reaction mixture for triggering a thermite reaction of the mixture; and 5) wherein the device is configured with a structure for substantially preventing longitudinal expansion of products of the thermite reaction and promoting lateral expansion of the products of the thermite reaction;

b) igniting the thermite reaction mixture at the location, thereby producing molten thermite reaction products;

c) expanding the thermite reaction products to fill the well through use of gas-generating means to substantially increase the volume of the molten thermite reaction products; and d) constraining the molten thermite reaction products longitudinally and allowing the molten thermite reaction products to expand substantially only laterally within the well and then allowing the molten thermite reaction products to cool to a porous solid mass thereby forming the structure within the well.

20. The method of claim 19, wherein step d) further comprises the step of allowing the molten thermite reaction products to cool while substantially preventing escape of any gas generated within the molten thermite reaction products.

21. The method of claim 19, further comprising the step of drilling a hole through the porous solid mass so as to form a screen in the well for flow and sand control.

22. A method of minimizing lost circulation within a well occurring within a lost circulation zone having lost circulation flow paths, comprising the steps of:

a) lowering a reaction package into a well to the location of the zone, the reaction package comprising an elongate cylindrical housing having an upper end and a lower end, a thermite reaction mixture placed within the housing between the upper and lower ends, an upper closure closing off the upper end of the housing and a lower closure closing off the lower end of the housing; and an ignition module in communication with the thermite reaction mixture for triggering a thermite reaction of the mixture;

b) providing with the reaction package gas generating materials;

c) igniting the thermite reaction mixture at the zone, thereby producing molten thermite reaction products;

d) expanding the thermite reaction products to fill the well at the location of the zone through use of the gas generating materials, the materials substantially increasing the pore volume of the molten thermite reaction products, and e) allowing the thermite reaction products to cool and seal the lost circulation flow paths.

23. The method of claim 22, wherein the gas generating materials comprise reactants placed within the thermite reaction mixture.

24. The method of claim 22, wherein the gas generating materials comprise pressurized gas added to the thermite reaction mixture.

25. The method of claim 22, wherein the gas generating materials comprises pressurized air present within the cylindrical housing between the upper and lower closures.

26. The method of claim 22, wherein the gas generating materials comprises a pressure balancing system placed within or adjacent to the cylindrical housing.

27. The method of claim 22, wherein the thermite reaction mixture comprises an iron oxide and aluminum thermite reaction mixture and wherein silicon carbide is present in a sufficient amount and of a particle size that it prevents iron products from agglomerating and forming large masses of iron in the products of the thermite reaction.

* * * * *